United States Patent [19]

Kawaguchi

[11] 4,054,028

[45] Oct. 18, 1977

[54] FUEL COMBUSTION APPARATUS

[75] Inventor: Katsuyuki Kawaguchi, Nagasaki, Japan

[73] Assignee: Mitsubishi Jukogyo Kabushiki Kaisha, Tokyo, Japan

[21] Appl. No.: 608,503

[22] Filed: Aug. 28, 1975

[30] Foreign Application Priority Data

Sept. 6, 1974 Japan ..... 49-101950

[51] Int. Cl.[2] ..... F02C 3/00

[52] U.S. Cl. ..... 60/39.23; 60/39.65; 431/10; 431/352; 431/353

[58] Field of Search ..... 60/39.65, 39.23, 39.74 R, 60/DIG. 11; 431/10, 351, 352, 353

[56] References Cited

U.S. PATENT DOCUMENTS

| | | | |
|---|---|---|---|
| 2,227,666 | 1/1941 | Noack | 60/39.23 |
| 2,446,059 | 7/1948 | Peterson et al. | 60/39.23 |
| 2,458,497 | 1/1949 | Bailey | 60/39.23 |
| 3,099,134 | 7/1963 | Calder et al. | 60/39.65 |
| 3,577,878 | 5/1971 | Greenwood et al. | 60/39.23 |
| 3,589,127 | 6/1971 | Kenworthy et al. | 60/39.65 |
| 3,859,786 | 1/1975 | Azelborn et al. | 60/39.65 |
| 3,872,664 | 3/1975 | Lohmann et al. | 60/39.65 |
| 3,914,091 | 10/1975 | Yamagishi et al. | 431/10 |
| 3,927,520 | 12/1975 | Arvin et al. | 60/39.65 |
| 3,958,413 | 5/1976 | Cornelius et al. | 60/39.65 |

FOREIGN PATENT DOCUMENTS

| | | | |
|---|---|---|---|
| 1,033,539 | 7/1953 | France | 431/352 |
| 917,080 | 12/1946 | France | 60/39.23 |

*Primary Examiner*—Carlton R. Croyle
*Assistant Examiner*—Robert E. Garrett

[57] ABSTRACT

A fuel combustion apparatus of a double-shell construction in which the inner shell is composed of an upstream small-diameter section, a downstream large-diameter section, and a conically-shaped connecting section between the two sections of different diameters, all the sections being aligned and connected together on a common axis. Fuel injection valve and a first air supply port equipped with swirl blades surrounding the valve are provided at the upstream end of the small-diameter section of the inner shell. The cylindrical wall of the small-diameter section is not formed with any air supply port, but second air supply ports shrouded with scoops are formed in the cylindrical wall portion of the large-diameter section close to the small-diameter section. On the upstream side of the first air supply port is installed means for controlling the rate of air supply to the same port.

7 Claims, 7 Drawing Figures

FUEL COMBUSTION APPARATUS

This invention relates to a fuel combustion apparatus capable of reducing the emissions of nitrogen oxides and smoke that are produced in the combustion of fuel.

The nitrogen oxides (hereinafter referred to as "NOx") and smoke, formed on combustion of fuel, can be responsible for various public nuisances. In order to meet the demand of the times for prevention of such nuisances and for environmental protection, it is of urgent necessity today to reduce the NOx and smoke emissions from fuel-burning equipment.

A conventional fuel combustor, as schematically illustrated in FIG. 1, comprises an inner shell 101 and an outer shell accommodating the inner one, so that fuel for combustion may be supplied leftward from the right end as viewed in the Figure into an annular passage 103 formed between the two shells. At the head of the inner shell 101 is installed a fuel injection valve 104, which is surrounded by an air supply port 105 equipped with swirl blades. The inner shell 101 is formed with a plurality of air holes 106, 107.

Fuel is injected under pressure, generally in the form of a cone (as indicated at 110), from the fuel injection valve 104 into the inner shell 101. Air for combustion is supplied from the annular passage 103 into the inner shell 101 through the air supply port 105 and air holes 106 to permit the combustion of fuel. While air is also supplied from the air holes 107 in the rear part of the inner shell, it is intended for use as dilution air that will maintain the gas burning in the inner shell at a predetermined temperature.

The ordinary combustion apparatus with the construction described has the following drawbacks:

A. Mixing of air and fuel in the vicinity of the injected fuel cone 110 that governs the smoke and NOx production is not uniform, and localized adjustment of the mixing condition is infeasible.

B. The air fuel ratio does not correspond to changes in the load, and the smoke and NOx production is high when the apparatus operates at heavy loads.

C. Since a large volume of air is supplied around the injected fuel cone 110 for low-pollution combustion of a lean mixture, the combustion tends to be instable with difficulty of ignition and frequent blowout.

D. The many air holes, formed in a number of rows in the wall of the inner shell, limit the penetration of air centripetally of the shell, resulting in poor air fuel mixing.

E. The air holes being formed in succession in the wall of the inner shell, there is no clear distinction between primary and secondary combustion zones, thus failing to achieve the end of pollution control.

The present invention has for its object to eliminate these drawbacks of the existing equipment and provide a fuel combustion apparatus capable of controlling the NOx and smoke production and thereby contributing to the prevention of air pollution.

The above and other objects, features, and advantages of the invention will become more apparent from the following description and the accompanying drawings showing embodiments thereof. In the drawings.

The embodiments of the invention will now be described in detail with reference to FIGS. 2 through 7.

Figure 1:
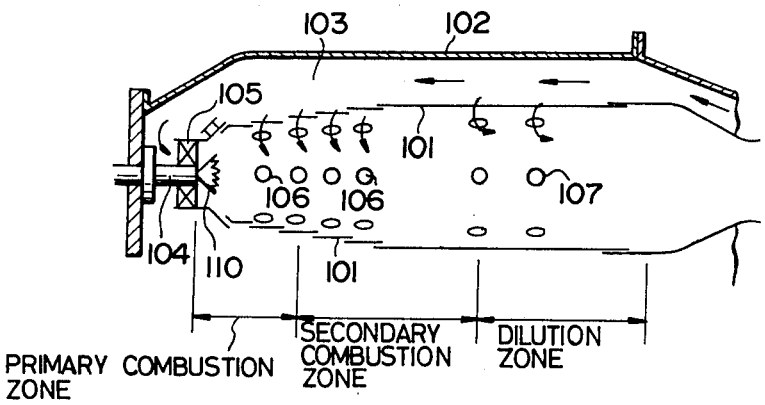
FIG. 1 is a schematic sectional view of a conventional fuel combustion apparatus.
Figure 2:
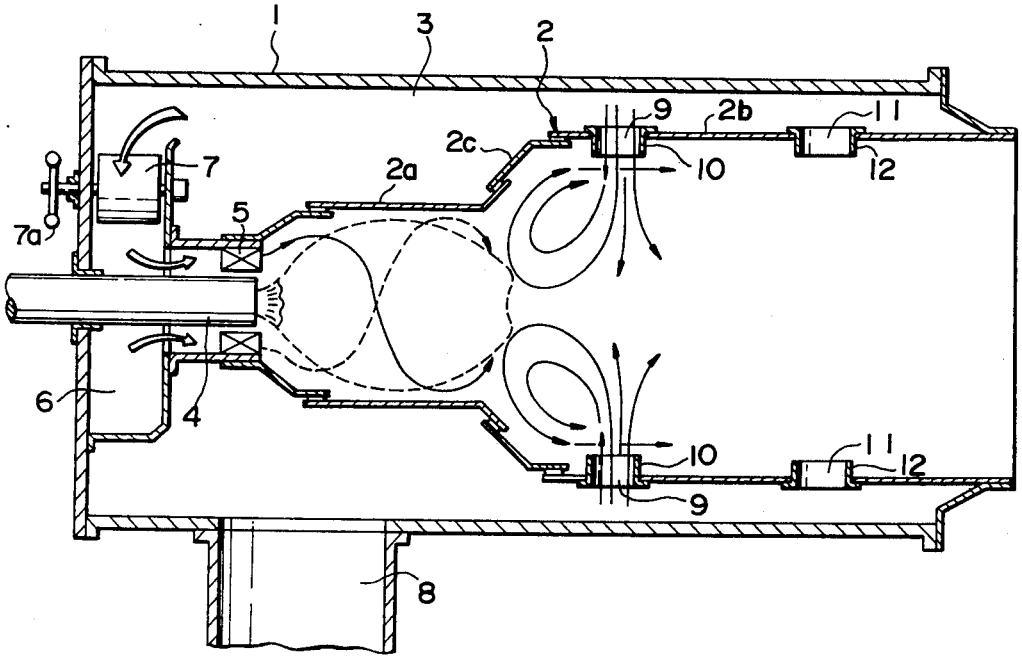
FIG. 2 is a sectional view of a fuel combustion apparatus embodying the invention.
Figure 3:
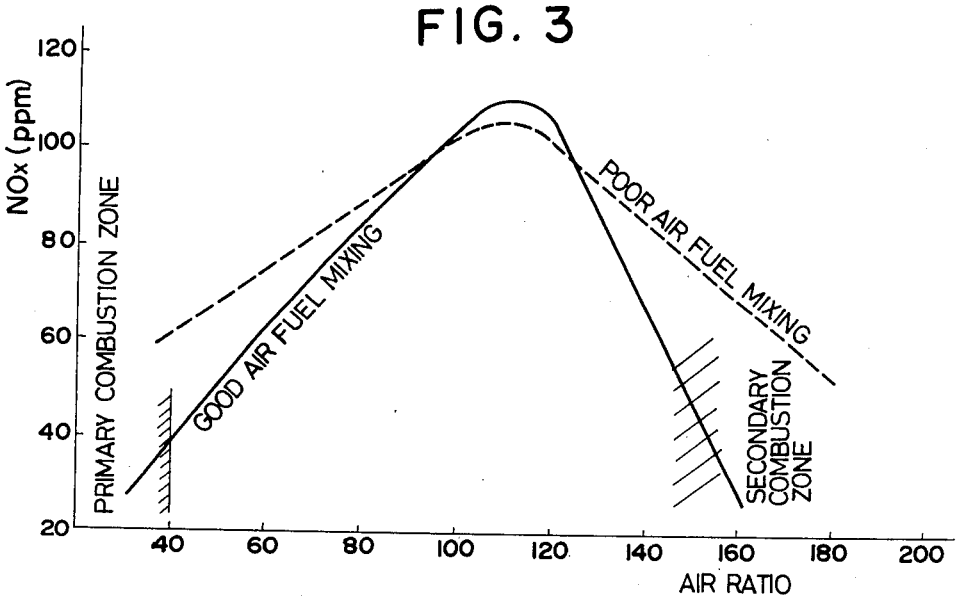
FIG. 3 is a graph showing the characteristics of the combustion apparatus.

In FIG. 2, which shows the first embodiment of the invention, an outer shell 1 accommodates a coaxial inner shell 2, defining an annular space 3 therebetween. The inner shell consists of a small-diameter section **2*a*, a large-diameter section 2*b*, and a conically-shaped connecting section 2*c*** between the two sections of different diameters.

A fuel injection valve 4 is installed at the end of the outer shell and opens in one end portion of the small-diameter section **2*a*. Around the fuel injection valve 4 there is a swirler 5 having swirl blades for supplying air for combustion to the inner shell 2. On the upstream side of the swirler is formed an air chamber 6, and an air control vane 7 is mounted in the space communicating the air chamber 6 with the annular space 3 to control the amount of air to be supplied. The air control vane 7 is manipulatable from the outside of the outer shell 1 by means of an operating handle 7*a*. An air supply pipe 8, communicated at one end with the annular space 3 through the outer shell and at the other end with an air source not shown, supplies the annular space 3 with a necessary amount of air for combustion of dilution and cooling. The wall portion of the large-diameter section 2*b* close to the connecting section 2*c* of the inner shell 2 is formed with a suitable number of air holes 9, each of which is shrouded with a scoop 10 extending perpendicularly to the axis of the inner shell. At some distance downstream from these air holes 9, another group of holes 11 for dilution air are formed, in a suitable number, through the wall of the inner shell. The dilution air holes 11 are also provided with scoops. The small-diameter section 2*a*** of the inner shell is not perforated for air supply.

The operation of the first embodiment of the invention with the foregoing construction will now be explained. For starting the apparatus, the air control vane 7 is adjusted so that a necessary amount of air for ignition is supplied to the swirler 5 surrounding the fuel injection valve 4. When the apparatus runs at load, the amount of air being supplied to the swirler 5 is adjusted by means of the air control vane 7, and a rich mixture is burned within the small-diameter section **2*a* of the inner shell. This small-diameter section 2*a* constitutes a primary combustion zone. As will be readily understood by those skilled in the art, fuel is injected from the fuel injection valve 4 into the small-diameter section 2*a***.

Air admitted from the swirler 5 into the small-diameter section **2*a* (i.e., the primary combustion zone) is caused to swirl, in the direction indicated by arrows within the small-diameter section, by the swirl blades of the swirler 5. The swirling air stream moves toward the large-diameter section 2*b*, where the swirl angle is increased with a decrease in the axial flow velocity, and the gas retention time is extended. Then, air from the holes 9, with its penetration increased by the scoops 10, gets into the large-diameter section 2*b***, and the unburned gas is mixed thoroughly with the air to form a uniform mixture for complete combustion. Here a secondary combustion zone is formed.

The gas completely burned in the secondary combustion zone flows downstream, diluted and cooled by the air introduced through the dilution air holes 11 and is finally discharged from the combustion apparatus.

When the load is variable, a satisfactory combustion conditions can be maintained by adjusting the air control vane 7 in such a way as to keep a constant ratio of air to fuel (air fuel ratio) in the primary combustion zone.

According to the present invention, as described above, the distribution of air between the primary and secondary combustion zones is properly adjusted by means, such as the air control vane 7, for adjusting the flow rate of air to the primary combustion zone so as to ensure ready ignitability at the start and extreme stability of combustion. Combustions in the primary and secondary zones may be effected under the conditions easily chosen for inhibiting the NOx production, as graphically indicated in FIG. 3. An additional advantage is that the overall amount of air is little different from that for ordinary combustion. The carbon produced by the combustion of the rich mixture in the primary combustion zone is burned again by the combustion under lean mixture conditions in the secondary combustion zone. Also, in the secondary zone the exhaust gas from the primary zone is burned and thereby the production of NOx is further decreased without the provision of any special exhaust recycling means.

Further, in accordance with the invention, the primary combustion zone for the burning under rich mixture conditions is followed by the secondary combustion zone of a larger inside diameter and air for combustion is separately supplied to the two zones. Thus, the primary and secondary combustion zones are distinctly partitioned so that the primary combustion flame is confined within a localized region for gasification of fuel and, in the secondary combustion zone, the gas retention time is extended and the gas is positively mixed with fresh air. In this way the unburned gas produced in the primary combustion zone can be completely burned in the secondary zone, with the consequence that the NOx and smoke emissions are decreased for less air pollution.

Figure 4:
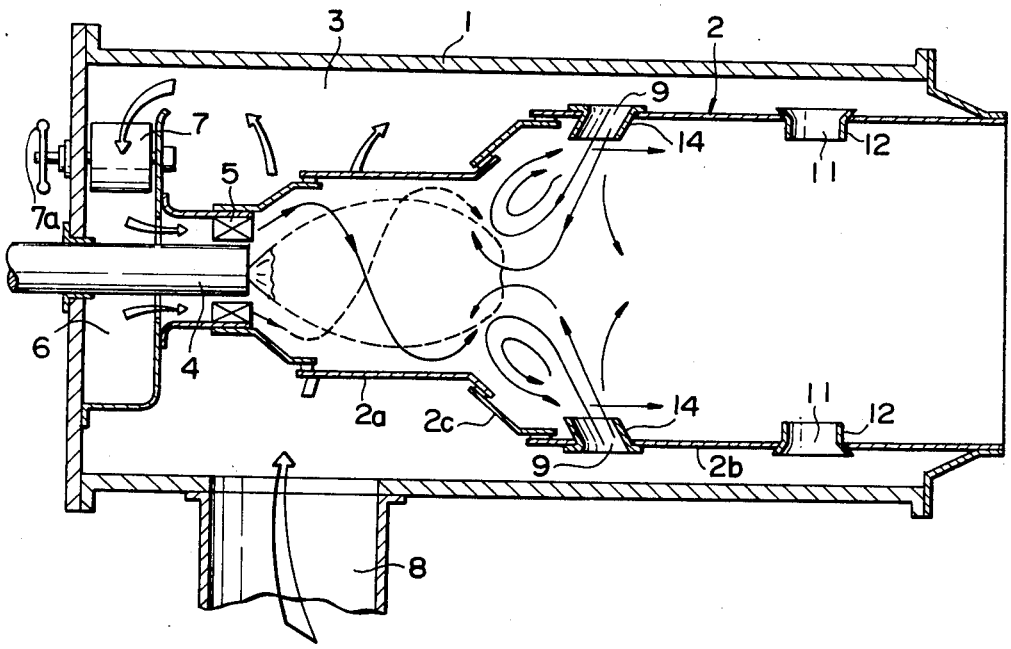
FIGS. 4 to 7 are sectional views of other embodiments of the invention.

FIG. 4 illustrates the second embodiment of the invention, which is similar to the first embodiment shown in FIG. 2 except that scoops 14 of the air holes 9 formed in the side wall of the inner shell 2 do not extend perpendicularly to the axis of the shell as the scoops 10 of the first embodiment do, but are inclined on the fuel injection (upstream) side or toward the small-diameter section 2*a*. Throughout the two Figures, therefore, like parts are designated by like reference numerals and their detailed description is omitted. The provision of the scoops 14 inclined toward the small-diameter section brings an advantage in addition to those already described of the first embodiment. The streams of air introduced through these scops 14 make it easier to form a hot back flow region in the combustion air and ensure more stabilized combustion than in the first embodiment.

Figure 5:
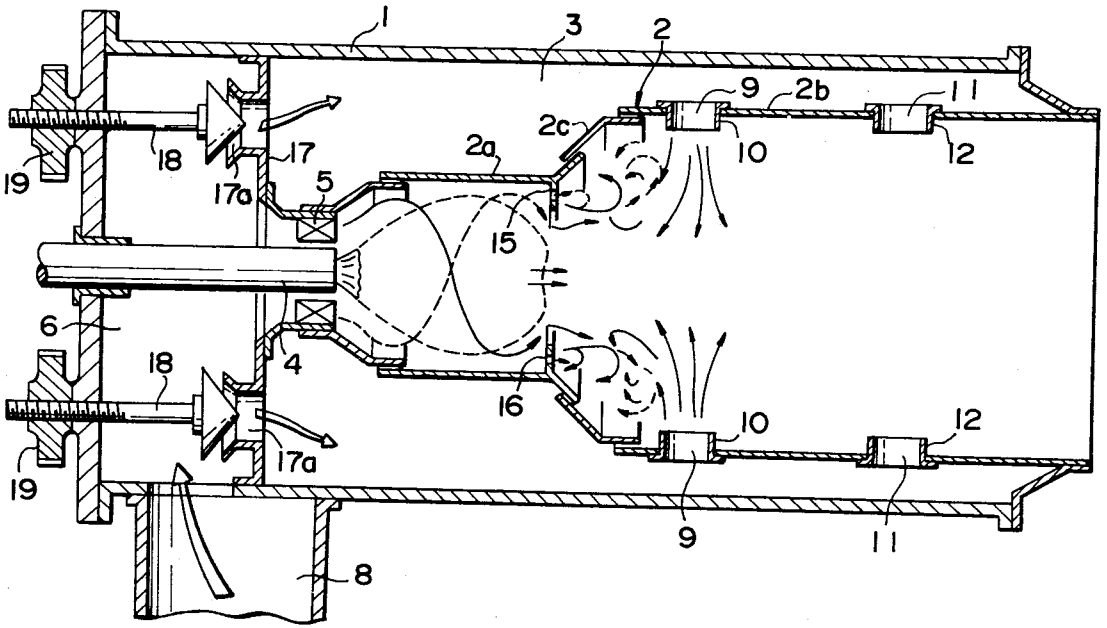

FIG. 5 shows the third embodiment of the invention, which is another modification of the first embodiment of FIG. 2, further comprising a baffle disk 15 secured to the downstream end of the small-diameter section 2*a* of the inner shell 2, contiguous to the concially-shaped connecting section 2*c*. The baffle disk 15 has a plurality of perforations 16.

Moreover, the air chamber 6 is divided by a partition wall 17 fast on the inner surface of the outer shell 1 to establish direct communication between the inner shell 2 and the air supply pipe 8. This partition wall 17 separates the air supply into two, one portion flowing into the inner shell 2 through the swirler 5 and the other portion into the annular space 3. The partition wall is formed with an air hole or holes 17*a* at a point or points of communication with the annular space 3. Every such air hole 17*a* is engaged with a damper 18, which can be moved toward and away from the air hole by manipulating a gearing 19 outside of the outer shell 1. In this manner the rates of air supply to the annular space 3 and the swirler 5 can be controlled. The other components are shown with the same reference numerals as of their counterparts in FIG. 2 and are not specifically described here.

In this embodiment, a back flow region is formed in the stream of combustible mixture by the action of the baffle disk 15 in cooperation with the contrivance in the first embodiment already described. Part of hot combustion gas flows back into the back flow region and fires the unburned gas to maintain the combustion and keep up the flame in the high-speed stream of gaseous mixture, eliminating the possibility of a blow-out.

Figure 6:
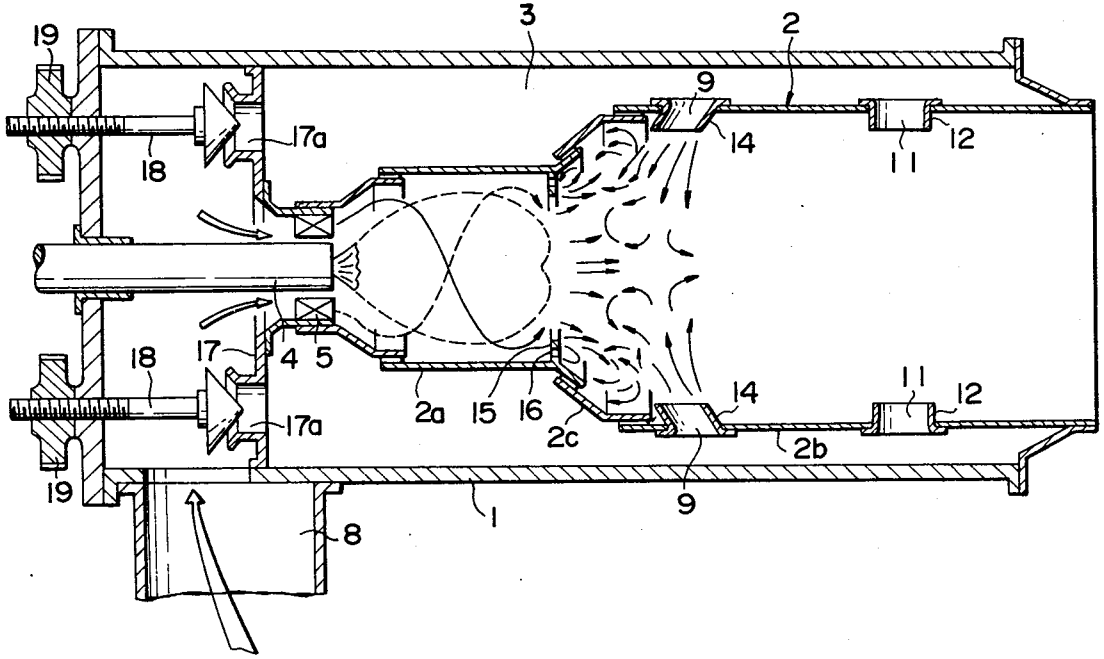

FIG. 6 represents the fourth embodiment of the invention or a modification of the third embodiment shown in FIG. 5 with the scoops 14 of the second embodiment of FIG. 4 provided around the air holes 9 in the inner shell and inclined toward the small-diameter section 2*a*. Detailed description of the other parts in FIG. 6 comparable to those in FIG. 5 is omitted, those parts being simply indicated by like numerals.

In addition to the features of the first embodiment already considered, this fourth embodiment forms a high temperature region flowing back into the combustible gas stream by means of the baffle disk 15 as well as by the jets of air in the reverse direction from the air holes 9 along their scoops 14. Thus, even when the flow velocity of the gas in the secondary combustion zone is high, stabilized combustion flame can be obtained.

Figure 7:
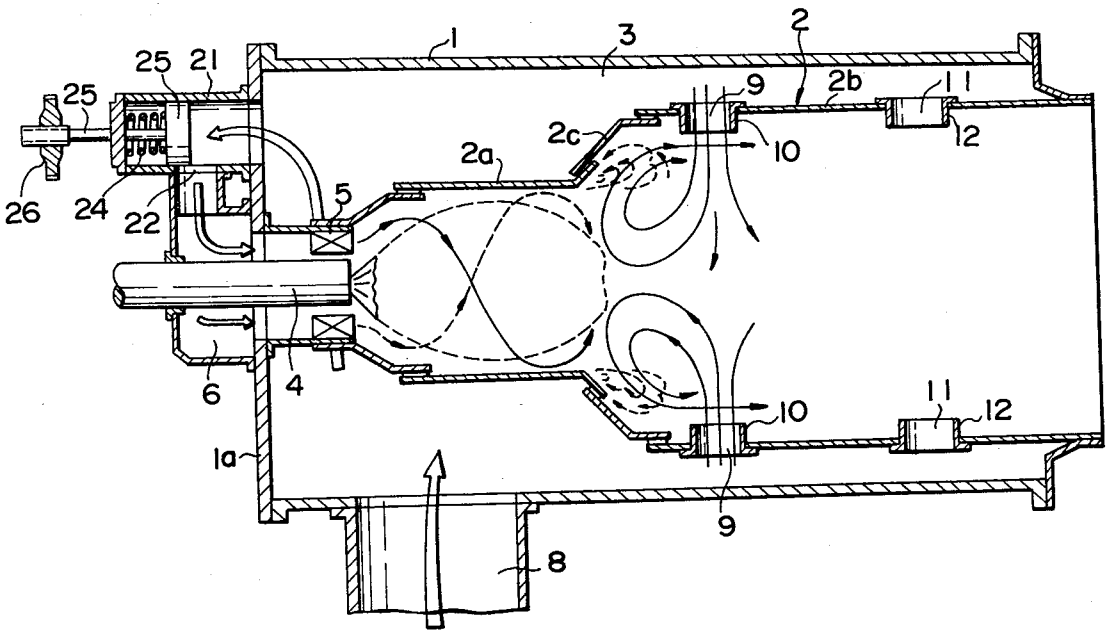

FIG. 7 shows the fifth embodiment of the invention, which differs from the first embodiment shown in FIG. 2 in the mechanism for adjusting the amount of air to be supplied to the swirler.

This embodiment additionally comprises a cylinder 21, which opens at one end in the annular space 3 through the end wall 1*a* of the outer shell 1. The cylinder 21 has a port 22 on one side for communication with the air chamber 6, which in turn communicates with the swirler 5. The cylinder 21 slidably accommodates a piston 23, which is baised by a spring 24 toward the open end of the cylinder. A rod 25 connected to the piston 23 is equipped with a gear 26 for controlling the stroke of the piston 23 from the outside. The construction is otherwise similar to the first embodiment, and the parts in FIG. 7 having counterparts in FIG. 2 are designated by like numerals and their description is omitted.

In the fifth embodiment, the elasticity of the spring 24 in the cylinder 21 is so chosen and adjusted as to supply only the amount of air necessary for ignition at the start to the space around the fuel injection valve 4. Part of the air introduced into the annular space 3 through the air supply pipe 8 is then supplied to the swirler 5 via the port 22 and air chamber 6. After the ignition, the combustion pressure rises with the increase of the combustion load, the pressure forcing the piston 23 gradually leftward as viewed in FIG. 7 until the port 22 is wide open and the rate of air supply to the swirler 5 is accordingly high. Consequently, a constantly rich air fuel ratio is automatically maintained, thus ensuring stable combustion.

While the present invention has been described with reference to five embodiments thereof, it will be understood by those skilled in the art that the invention is not limited thereto but may be otherwise variously embodied without departing from the spirit of the invention. For example, in such applications as boilers and other furnaces where the percentages of excess air are not so high, the dilution air holes 11 may be omitted. The handle *7a,* gearing 19, and gear 26 need not always be hand-operated but may be suitably modified, if desired, for power driving by a motor or the like. The present invention is applicable to continuous combustion furnaces, boilers, gas turbines and the like. Also, the apparatus can run on a wide variety of fuels, liquid or gaseous.

According to the present invention, as has been described above, many advantages are obtained. Major advantages may be summarized as below:

a. Since the ratio of the flow rate of swirling air stream to that of air streams penetrating the swirl from the holes of the cylindrical wall is adjustable, the air fuel ratio in the localized region can be controlled as desired.

b. The swirling stream of air supplied around the fuel injection valve is adjusted to effect rich mixture combustion (in the primary combusiton zone), and combustion air is issued from scooped air holes in the cylindrical wall of the inner shell section of expanded diameter, immediately behind the flame of rich mixture in combustion, so that the air fuel ratio is increased and the lean mixture is burned. In this way the unburned portion of the rich mixture is burned up (in the secondary combustion zone), thus reducing the NOx and smoke emissions.

c. In accordance with the invention, either scooped back-flow air holes are provided for the secondary combustion zone for the lean mixture or a perforated disk for combustion stabilization is secured to the downstream end of the primary combustion zone for the rich mixture. This materially extends the combustible air-fuel ratio limits and improves the combustion stability.

d. Means for controlling air supply is installed outside of the combustion shell structure and the flow rate of swirling air being supplied around the fuel injection valve is adjusted according to changes in load (i.e., in fuel flow rate). Thus, the air fuel ratio can be kept constant, and localized air fuel ratio in the primary combustion zone can be properly controlled.

What is claimed is:

1. A fuel combustion apparatus comprising an outer shell defining an enclosed hollow chamber, an inner shell composed of an upstream small-diameter section located within said chamber, a downstream large-diameter section extending in part outwardly of one end of said outer shell and a conically shaped connecting section between the two sections of different diameters, all said sections being aligned and connected together on a common axis and spaced from said outer shell, duct means extending through said outer shell for the supply of air to the space between said shells, a fuel injection valve and a first air supply port in communication with the space between said shells equipped with swirl blades surrounding the injection valve, said injection valve and air supply port being both provided at the upstream end of the small-diameter section of the inner shell, both the cylindrical wall of the small-diameter section and the conical wall of the connecting section of the inner shell being not perforated for air supply, second air supply ports in communication with the space between said shells formed in the cylindrical wall portion of the large-diameter section close to the connecting section, each of said second ports being shrouded with scoops extending at an angle into the large-diameter section at least perpendicularly to the direction of flow of said fuel, and means installed on the upstream side of the first air supply port for controlling the rate of air supply from said duct to the said first port whereby the flow of air supply to said first port relative to said second ports may be regulated.

2. The apparatus according to claim 1, wherein said scoops are inclined at an angle directed upstream.

3. The apparatus according to claim 1 including a perforated baffle disk secured to the inner wall portion of the small-diameter section close to the large-diameter section of the inner shell.

4. The apparatus according to claim 1, wherein said air supply controlling means including a cylinder that opens in the space between the outer and inner shells and a piston that is actuated by the pressure of air in said annular space.

5. The apparatus according to claim 4 including means operable from the exterior of said outer shell to adjust said piston.

6. The apparatus according to claim 1, wherein said air supply control comprises a hollow enclosed housing located over the upstream end of said small-diameter section and includes a valve member located in the wall of said housing to regulate the flow of air into said housing from the space between said shells.

7. The apparatus according to claim 6 including means operable from the exterior of said outer shell to adjust said valve member.

* * * * *